US006298787B1

(12) United States Patent
Warnagiris

(10) Patent No.: US 6,298,787 B1
(45) Date of Patent: Oct. 9, 2001

(54) NON-LETHAL KINETIC ENERGY WEAPON SYSTEM AND METHOD

(75) Inventor: Thomas J. Warnagiris, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 0 days.

(21) Appl. No.: 09/412,121

(22) Filed: Oct. 5, 1999

(51) Int. Cl.[7] ..... F42B 12/34; F42B 8/00; F42B 30/02

(52) U.S. Cl. ..... 102/502; 102/498; 102/529

(58) Field of Search ..... 102/502, 498, 102/529

(56) References Cited

U.S. PATENT DOCUMENTS

| | | |
|---|---|---|
| 3,152,547 | 10/1964 | Kyle . |
| 4,030,420 | 6/1977 | Skagerlund . |
| 4,549,464 | 10/1985 | Hawkins et al. . |
| 4,625,647 | 12/1986 | Laures . |
| 4,773,328 | 9/1988 | Germershausen et al. . |
| 4,823,702 | 4/1989 | Woolsey . |
| 4,991,508 | 2/1991 | Ziemba . |
| 5,221,809 | 6/1993 | Cuadros . |
| 5,366,179 | 11/1994 | Manhalter . |
| 5,649,466 | 7/1997 | Genovese . |
| 5,691,501 | 11/1997 | Gilbert . |
| 5,696,347 | 12/1997 | Sebeny, Jr. et al. . |
| 5,792,976 | 8/1998 | Genovese . |

*Primary Examiner*—Charles T. Jordan
*Assistant Examiner*—Kimberly S Smith
(74) *Attorney, Agent, or Firm*—Baker Botts L.L.P.

(57) ABSTRACT

A non-lethal kinetic energy system comprises a propellant means in mechanical communication with the combination of a personnel target proximity detection means, an air bag carried in an uninflated condition, and a means to inflate the air bag responsive to a signal provided by the proximity detection means as the system approaches a personnel target. The system may include a delay element for selective adjustment of the kinetic energy delivered to the personnel target. The invention also provides a method of operating a non-lethal kinetic energy system comprising the steps of deploying the system toward a personnel target, sensing the proximity of the target, sending a signal to an air bag inflation means at a predetermined distance from the target, and inflating the air bag before impacting the target.

20 Claims, 2 Drawing Sheets

NON-LETHAL KINETIC ENERGY WEAPON SYSTEM AND METHOD

BACKGROUND OF THE INVENTION

1. Technical Field

This invention relates generally to non-lethal projectiles. More particularly, the invention relates to a nonlethal projectile having target proximity detection and controlled kinetic effects.

2. History of Related Art

For some time, both military and law enforcement agencies have been investigating alternatives to conventional non-lethal weapons. Ideally, such weapons should be effective at a range equivalent to conventional fire arms, without causing permanent damage to the intended target personnel. To-date, these needs have not been met.

It is well known that the kinetic energy in a relatively small projectile is sufficient to stun, disable, and/or bring a person to the ground. Evidence of this occurs in combat situations when a small arms projectile impacts a relatively large surface, such as a bullet-proof vest, worn by the person fired upon. If the round does not penetrate, most of the kinetic energy is distributed over the surface, and tends to stun or bring down the targeted personnel. Little or no long-term damage results.

Taking advantage of this principle, several non-lethal weapons have been developed. Some use large projectiles to minimize the possibility of penetration. The difficulty inherent in such an approach is that a large projectile may induce sufficient air drag to minimize or obviate its value as a non-lethal weapon.

Another difficulty imposed by conventional approaches to this problem is the difficulty of controlling impact kinetic energy at personnel targets which are located at varied distances from the firing point. That is, air drag over distance decreases the kinetic energy of the projectile significantly; targets which are relatively close to the firing point will receive a maximum amount of kinetic energy (possibly more than is necessary or intended), while distant targets may receive insufficient kinetic energy to accomplish the objective—to stun or bring down the personnel target.

Further, it may be desirable to vary the kinetic energy delivered to the target based on factors other than the distance to the target. For example, the exigencies of the situation, or the size of the target, may dictate use of a higher kinetic energy than would normally be expected. None of the known non-lethal weapon alternatives provides the ability to adjust kinetic energy, either before deployment, or "on-the-fly."

Finally, it is desirable to provide some assurance that non-lethal operation of the weapon system be maintained, even in the face of system failure. For example, if a non-lethal projectile fails to deploy properly, there should be some alternative or "backup" mechanism which operates to minimize the chance of personnel target penetration.

Therefore what is needed is a non-lethal kinetic energy weapon system that provides conventional fire arm range capability, yet delivers a non-lethal dose of kinetic energy to a personnel target. This system should be operable at varied distances, and provide the ability to adjust the kinetic energy delivered to the personnel target. Such adjustment should be available to the weapon user prior to firing/deployment, or alternatively, after deployment and before impact. Further, the system should provide the capability to assure non-lethal operation in the event of a first-order failure, such that the chance of target penetration is minimized.

SUMMARY OF THE INVENTION

The non-lethal kinetic energy system of the present invention comprises an optional inner casing which typically carries a personnel target proximity detector and an uninflated air bag, along with a means to inflate the air bag that responds to a signal provided by the proximity detector. Some type of propellant, such as gun powder or gas, operates in mechanical communication with the inner casing to deploy the system toward the target. The system may be circumscribed by an outer casing, such as in a shot gun shell arrangement, which completely encloses the propellant and the inner casing prior to deployment of the system.

In use, the system is deployed toward a personnel target and the proximity detector, such as a Doppler radar system, is activated for detecting the range to the target. When the maximum effective distance from the target is reached, the proximity detector provides a signal to the inflation means, which in turn inflates the air bag prior to system contact with the personnel target. Depending on certain conditions, the inflation signal from the proximity detector may be delayed for some predetermined time period to provide more or less impact kinetic energy to the personnel target. These conditions include the amount of drag induced by the air bag during flight, the size of the personnel target, and the distance to the target.

The delay time period may be communicated to the system by means of electronic contacts, radio messaging, or non-contact interface means, such as ultrasound, infra-red, or other radiation.

The invention also includes a method of operating a non-lethal kinetic energy system comprising a personnel target proximity detector, an air bag, and a means to inflate the air bag responsive to the signal provided by the proximity detector, comprising the steps of deploying the system toward a personnel target, sensing the proximity of the target to the system, sending a signal to the air bag inflation means at a predetermined distance from the target, and inflating the air bag before impacting the target. The predetermined distance from the target at which the air bag may be inflated is typically from about 0.3 meters to about 30.0 meters. The method may include the steps of selecting a predetermined delay time period, communicating the delay to the system, and delaying the signal to the air bag inflation means by the predetermined delay time period. The delay can be selected prior to the deployment of the system, or after deployment of the system. The amount of delay after reaching the predetermined distance to the target is typically about 0.001 seconds to about 0.100 seconds.

The non-lethal kinetic energy weapon system may be deployed toward a single personnel target, or toward a multiplicity of personnel targets, as may be desirable for crowd control. Further, the system may include designing the inner casing so that penetration of the skin surface for a designated personnel target is unlikely to occur even if the air bag fails to inflate before impact.

BRIEF DESCRIPTION OF THE DRAWINGS

A more complete understanding of the structure and operation of the present invention may be had by reference to the following detailed description taken in conjunction with the accompanying drawings, wherein.

DETAILED DESCRIPTION OF PRESENTLY PREFERRED EXEMPLARY EMBODIMENTS

The present invention is founded on the idea of delivering a controlled amount of kinetic energy to a personnel target with the intent of disabling the targeted person, and doing so in a non-lethal manner. Although several non-lethal weapons have made use of large projectiles to minimize the possibility of penetration, the large size of the projectile provides an undesirable amount of air drag, to the point of minimizing the value of the projectile as an effective weapon. If the as-deployed size and density of the projectile can be maintained along most of the flight path on the way to the personnel target, most of the as-deployed kinetic energy will remain available for delivery to the target.

Figure 1:
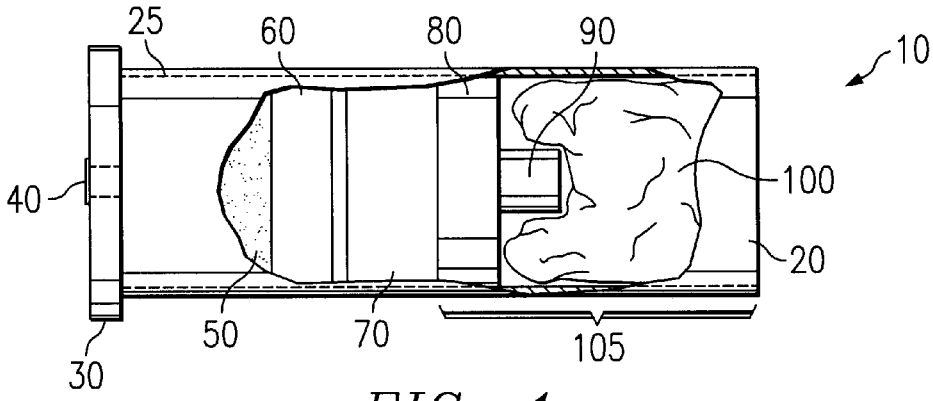
FIG. 1 is a side, cut-away, view of the non-lethal kinetic energy weapon system of the present invention.

Turning now to FIG. 1, a side-view of the non-lethal kinetic energy weapon system 10 can be seen. In this illustration, the system is shown contained within an outer casing 20. The system 10 comprises an optional inner casing 25, a propellant means 50 in mechanical communication with the inner casing 25, a personnel target proximity detection means 80, an uninflated air bag 100, and a means to inflate the air bag 90, all carried within or disposed within the optional inner casing 25.

Of course, the combination of the personnel target proximity detection means 80, the uninflated air bag 100, and a means to inflate the air bag 90 do not necessarily require a carrier in the form of an inner casing 25. These components may be affixed or tied together in such a way as to preclude separation during flight toward the personnel target. The combination of elements, apart from the inner casing 25, is designated as the projectile 105. Of course, the projectile may also comprise the battery/switch combination 70, and the inner casing 25. In the broadest sense, the energy system 10 therefore comprises a projectile 105 in mechanical communication with a propellant means 50. To provide maximum kinetic energy upon delivery to the personnel target, the projectile 105 and any accompanying inner casing 25 and/or battery/switch combination 70 should be assembled as densely as possible.

The propellant means may comprise gun powder, pyrotechnic chemicals, explosive fluids, gas, gas contained within a separate cartridge, or other rapidly-expanding, propellant means which, in mechanical communication with the inner casing 25, or the projectile 105 serve to propel the inner casing 25 or projectile 105 over some distance toward a personnel target. As shown in FIG. 1, the propellant means 50 may take the form of gun powder, which is ignited by a primer 40, in the base 30 of the outer casing 20. Wadding 60, such as that commonly used in conventional shotgun shells, is placed between the propellant means 50 and the inner casing 25 to distribute the propulsive force across the base of the inner casing 25 or projectile 105 when the system is deployed toward the personnel target.

A battery/switch combination 70 may be used to power the proximity detection means 80 upon deployment of the system 10 toward a personnel target. Rapid acceleration of the system 10 may be used to activate a switch connected in series between the battery and the proximity detection means 80 to energize the proximity detection means 80 for operation and detecting the distance to the personnel target as the system 10 traverses the line of flight toward the personnel target. The switch in this case may be a mechanical contact which moves upon sensing rapid acceleration, or in the alternative, a non-mechanical switch which draws low current and fully activates the detection means 80 after acceleration is sensed. Such a switch may be composed of solely electronic components for greater reliability. Exemplary switches include those manufactured by Inertia Switch, Inc., such as their motion/inertia switch model 6UO-200, or more compact, solid-state devices available using micro-machining technology. A magnetic sensor, activated as the system 10 exits a gun barrel, may also be used.

The air bag 100, which may be carried within the inner casing 25 in an uninflated condition, should be constructed from aramid fibers, high-density polyethylene, or woven anti-ballistic materials, optionally weighted with lead, iron, or other high-density materials, and reinforced with nylon or polyester as needed. The air bag 100 should be constructed from a material which is flexible and easily compressed into a small space. Upon inflation, the air bag is preferably sized to occupy a volume of from about 0.01 cubic meters to about 1.00 cubic meters. The material used to fabricate the air bag 100 should be strong enough to prevent injury to the target personnel by the impact of the inner casing 25, the projectile 105, individual components, such as the battery/switch combination 70, proximity detection means 80, and the air bag 100 itself. Most preferably, the kinetic energy delivered to the personnel target should be within a range of from about 100 joules to about 1,000 joules. Thus, the combination of air bag surface area, combined with the mass of the system 10 and velocity at which the system 10 is delivered to the personnel target, will determine the ultimate energy delivered to the personnel target upon impact. The impact energy can be radically altered by delaying inflation of the air bag 100 along the flight path of the system 10 toward the personnel target.

For guidance in the application of the weapon system 10 to personnel targets, one can refer to the information provided in U.S. Pat. No. 5,221,809, entitled "Non-Lethal Weapons System," incorporated herein in its entirety by reference. This document includes a summary of several studies conducted to determine the limits of lethality for projectiles impacting human bodies, and the parameters that correlate to the threshold of lethality.

The means 90 to inflate the air bag 100 may comprise an initiator and gas cartridge combination which responds to the distance signal provided by the proximity detection means 80. The initiator and gas cartridge may be similar to, or identical to, those made by Pacific Scientific, model number 2-100940. The gas cartridge may be a frangible container with compressed gas contained therein, or a chemical combination of pyrotechnic material which ignites upon exposure to the activated initiator (or the signal provided by the proximity detection means 80) to produce a rapidly expanding gas volume which inflates the air bag 100. Typically, for use with the system 10, the air bag should be inflated within about 5 to about 15 milliseconds after the signal from the proximity detection means 80 is applied, and most preferably within about 10 milliseconds after the signal from means 80 is applied.

Figure 2A:
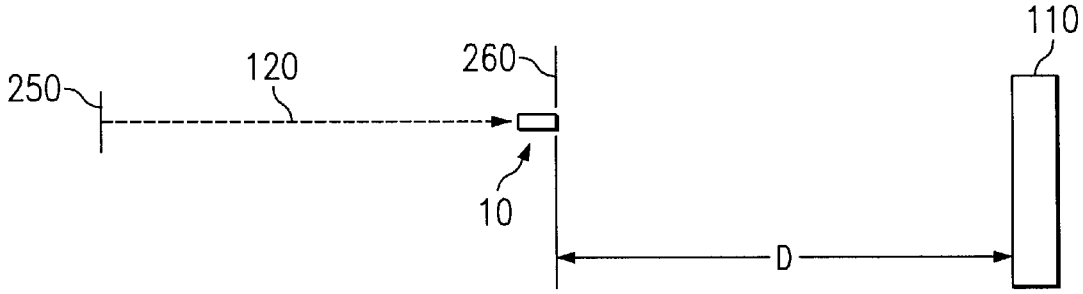
FIGS. 2A–2C illustrate the sequence of events which occur during the operation of the non-lethal kinetic energy system of the present invention.
Figure 2B:
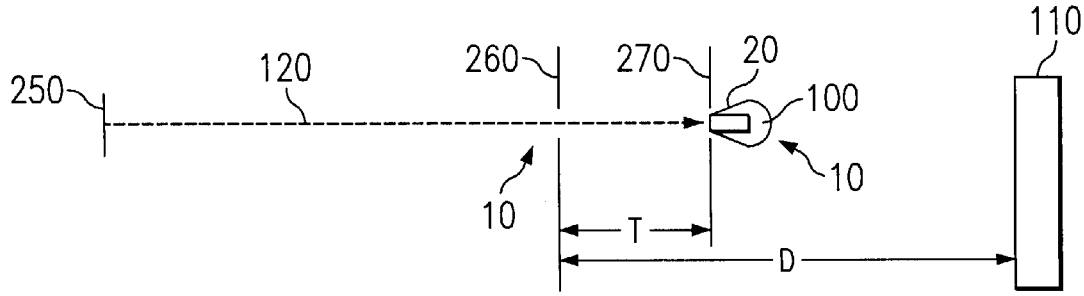
Figure 2C:
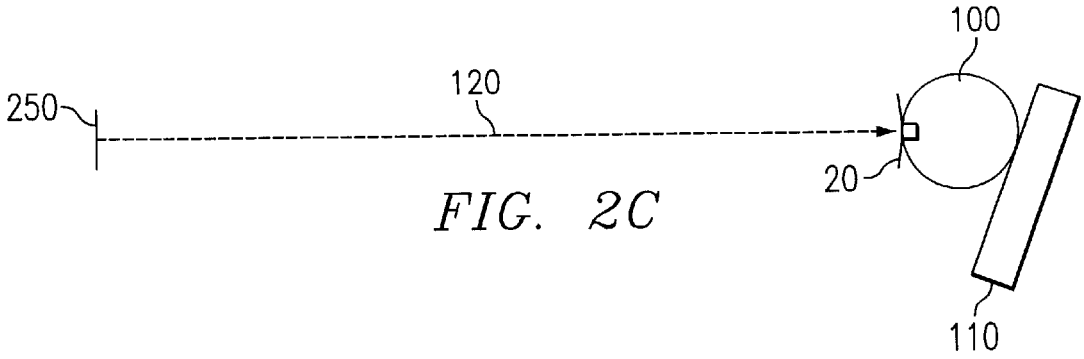

Referring now to FIGS. 2A, 2B, and 2C, the sequence of events encountered during operation of the system 10 can be seen. The steps involved in the method of operating the system 10 comprising a personnel target proximity detection means 80, an air bag 100, and a means to inflate the air bag 90, which responds to the signal provided by the proximity detection means 80, may include the steps of deploying the system 10 toward a personnel target 110, sensing the proximity of the target 110, sending a signal to the air bag inflation means 90 at a predetermined distance from the target "D", and inflating the air bag 100 before impacting the target 110.

The deployment point 250 is that point in physical space where the system 10 is released into the atmosphere for travel along a line of flight 120 toward the target 110. The deployment point 250 can also be designated as the point in time from which all future measurements are made along the system 10 line of flight 120 toward the target 110.

The maximum range point 260 is the point in space along the line of flight 120 where the maximum distance "D" from the target 110 is reached whereas the system 10 may first be effectively activated so as to inflate the air bag 100. If the air bag 100 is inflated prior to reaching the maximum range point 260, undesirable deceleration will occur due to air drag, and the system 10 will be ineffective as a non-lethal kinetic energy system. If activated sufficiently early along the line of flight 120, the system 10 may not even possess sufficient kinetic energy to reach the target 110. Typically, the predetermined distance "D" will be between about 0.3 meters and about 30.0 meters.

As will be discussed below, the system 10 may also comprise a delay element, typically carried within the optional inner casing 25, which provides a predetermined delay time period between the time that the proximity detection means 80 detects arrival of the system 10 at the distance "D" (i.e., the maximum range point 260) and the time the system 10 reaches the desired activation point 270, which occurs at some predetermined distance "T" after reaching the maximum range point 260. The distance "T" can also be characterized by the distance the system 10 travels during a predetermined delay time period. The predetermined delay time period is selectable, and is usually selected to occur between about 0.001 seconds and 0.100 seconds along the flight path 120 of the system 10, after the system 10 has reached the maximum range point 260.

After activation of the means 90 to inflate the air bag 100, the air bag 100 will become fully inflated as shown in FIG. 2C before impacting the target 110. The resulting kinetic energy upon impact should serve to disable the personnel target 110, or at least, to knock the personnel target 110 down.

Figure 3:
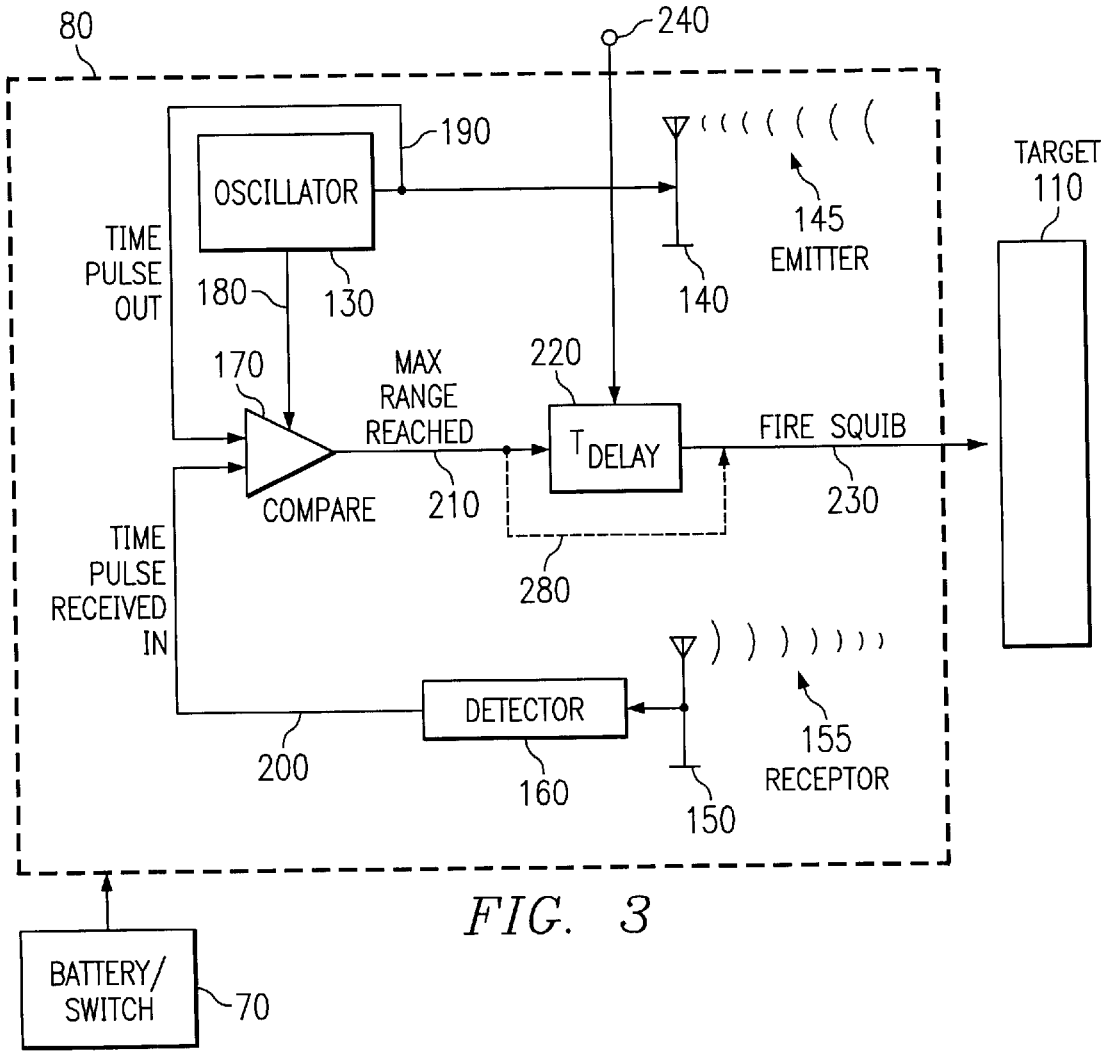
FIG. 3 illustrates one embodiment of a personnel target proximity detection means which may be employed by the present invention.

Turning now to FIG. 3, one of many possible configurations for the personnel target proximity detection means 80 can be seen. A clock oscillator 130 can be used to power an emitter 140 to provide a target signal 145. One exemplary implementation may include a Gunn diode oscillator driving an antenna to project radio waves toward the target 110. The target 110 will in turn reflect energy such as the return signal 155 to a receptor 150. For example, if a Doppler radar design is used to illuminate the target 110, a radar antenna may be used to receive the reflected signal, which is sent to a detector 160. Of course, those skilled in the art will realize that the emitter 140 and receptor 150 may be combined into a single antenna, in the case of radar emissions, as a more efficient combination. A diplexer or signal splitter can be used to separate the emitted and received signals.

The proximity detection means can also be designed as a pulse radar. In a pulse radar configuration, once the received signal has been detected at the detector 160, it is sent to a comparator 170 for determining the time between the emission of the signal from the emitter 140 to the reception of the signal at the receptor 150. The emitted signal is sent from the oscillator output to the comparator 170 as a signal initiation pulse 190, while the received signal is sent from the detector 160 to the comparator 170 as a signal received pulse 200. Using, for example, the oscillator clock as a timing device, the clock signal 180 can be used to measure the difference in time between the pulses 190 and 200, and further used to determine whether the maximum range point 260 has been reached by the system 10. When the maximum range point 260 is reached, the comparator 170 can then send a signal, maximum deployment range reached 210, to initiate inflation of the air bag 100, by firing a squib or initiator, and activating a gas cartridge, or by activating other air bag inflation means 90 directly. In this case, the dotted line 280 shows direct activation of the air bag inflation means via a trigger signal 230 by the comparator signal 210.

The system 10 may also contain a delay element 220, which receives the signal 210 from the comparator 170 when the maximum range point 260 is reached by the system 10. As mentioned previously, the signal 210 provided by the proximity detection means 80 may be delayed for a predetermined time period, which is typically between about 0.001 seconds and 0.100 seconds. This delay time period is determined by the time delay element 220. The predetermined time delay period may be selected by any of several different methods. There is a delay communication port 240, which may comprise any of several devices, including electrical contact means (e.g. simple conductive electrical contacts), a radio message interface means (e.g. a radio transmitter used by the operator to set parameters within the system 10 using a receiver that is an integral part of the system 10), or an electromagnetic interface (e.g., infrared, visual, photonic, or other radiation). The operator of the system 10 may select the predetermined time delay period (which is the time that it takes the system 10 to traverse the distance "T" and reach the activation point 270), and then communicate the predetermined time period to the delay element 220 prior to deployment of the system 10. Alternatively, the system operator may elect to communicate the predetermined time delay period to the system 10 after deployment of the system 10, and before impact at the target 110. In most cases, the distance "T" will be predetermined to occur within a range of about 0.3 meters to about 30.0 meters from the maximum range point 260.

In more sophisticated implementations of the system 10, the predetermined delay time period may be selected according to the size of the personnel target 110 toward which the system 10 is deployed. That is, the strength of the return signal 155 may be compared to that expected from a typical, or preselected, size target, at the range along the line of flight 120 computed at the time the system 10 is deployed. Larger than expected return signals 155 may result in the selection of a greater delay before the air bag 100 is inflated, while smaller than expected return signals 155 may result in activation of the system 10 without any delay at all. Optical methods may also be used to gauge the size of the target 110.

As a practical matter, it is important that the system 10 be designed so as to maintain non-lethal operation even in the face of radical failure, such as when the air bag 100 fails to inflate before impacting the target 110. Such non-lethal operation is most preferably implemented so that the skin surface of the target 110 is not penetrated upon impact. This objective can be accomplished by appropriate design of the inner casing 25, the air bag 100, and any other elements which arrive at the target 110 to include frangible surfaces, components that spread out or "mushroom" upon impact, viscous padding, fluid-filled shock absorbers, expandable safety parachutes sensitive to over-velocity conditions prior to impact, and other elements that can be incorporated into the design of the system 10 and used to minimize the impact force, and/or distribute the force over a sufficient surface area so as to minimize destructive contact, or the chance of lethal contact, with the personnel target 110 when the air bag 100 fails to inflate.

Although the present invention is described in terms of preferred exemplary embodiments, other uses of the invention are contemplated. Such uses are intended to fall within the scope of the following claims.

What is claimed is:

1. A non-lethal kinetic energy system comprising:

a projectile comprising personnel target proximity detection means that determines when the target is in a specified range along a line of flight;

an air bag;

a means to inflate the air bag, said inflation means disposed so as to inflate the air bag responsive to a signal provided by the proximity detection means; and a propellant means in mechanical communication with the projectile.

2. The system of claim 1 wherein the system includes an outer casing which completely encloses the air bag, the inflation means, and the propellant means prior to system deployment.

3. The system of claim 1 wherein the signal provided by the proximity detection means is delayed for a predetermined time period.

4. The system of claim 3 wherein the predetermined time period is between about 0.001 seconds and 0.100 seconds.

5. The system of claim 3 wherein the predetermined time period is determined by a delay element carried within the projectile.

6. The system of claim 3 wherein the predetermined time period is determined by a radio message transmitted to the system after deployment.

7. The system of claim 3 wherein the predetermined time period is determined by an operator of the system prior to deployment.

8. The system of claim 3 wherein the projectile carries a delay element in electronic communication with the air bag inflation means and the predetermined time period is communicated to the delay element prior to deployment using electrical contact means.

9. The system of claim 3 wherein the projectile carries a delay element in electronic communication with the air bag inflation means and the predetermined time period is communicated to the delay element prior to deployment using radio interface means.

10. The system of claim 3 wherein the projectile carries a delay element in electronic communication with the air bag inflation means and the predetermined time period is communicated to the delay element prior to deployment using electromagnetic interface means.

11. The system of claim 3 wherein the predetermined time period is determined by the size of a personnel target toward which the system is deployed.

12. A method of operating a non-lethal kinetic energy system comprising a personnel target proximity detection means an air bag and a means to inflate the air bag responsive to a signal provided by the proximity detection means comprising the steps of:

deploying the system toward a personnel target;

sensing the proximity of the target;

sending a signal to the air bag inflation means at a predetermined distance from the target; and inflating the air bag before impacting the target.

13. The method of claim 12 wherein the predetermined distance is between about 0.3 meters and about 30.0 meters.

14. The method of claim 12 comprising the steps of:

selecting a predetermined delay time period;

communicating the predetermined delay time period to the system; and delaying the signal to the air bag inflation means by the predetermined time period.

15. The method of claim 13 wherein the predetermined delay time period is selected prior to deployment of the system.

16. The method of claim 13 wherein the predetermined delay time period is selected after deployment of the system.

17. The method of claim 13 wherein the predetermined delay time period is communicated to the system using electrical contact means.

18. The method of claim 13 wherein the predetermined delay time period is communicated to the system using electromagnetic interface means.

19. The method of claim 13 wherein the predetermined delay time period is selected according to the size of a personnel target toward which the system is deployed.

20. A non-lethal kinetic energy system comprising:

an inner casing;

a propellant means in mechanical communication with the inner casing;

an outer casing which completely encloses the propellant means and the inner casing prior to system deployment;

a personnel target proximity detection means carried within the inner casing;

an air bag carried within the inner casing in an uninflated condition; and a means to inflate the air bag, said inflation means disposed within the inner casing and responsive to a signal provided by the proximity detection means wherein the signal provided by the proximity detection means is delayed for a predetermined time period between about 0.001 seconds and 0.100 seconds.

* * * * *